US008297186B2

(12) United States Patent
Gsell et al.

(10) Patent No.: US 8,297,186 B2
(45) Date of Patent: Oct. 30, 2012

(54) APPARATUS AND METHOD FOR CHANGING PRINTING PLATES

(75) Inventors: Thomas Gsell, Dillingen (DE); Rudolf Stroh, Duernau (DE)

(73) Assignee: manroland AG, Offenbach (Am Main) (DE)

( * ) Notice: Subject to any disclaimer, the term of this patent is extended or adjusted under 35 U.S.C. 154(b) by 0 days.

(21) Appl. No.: 13/080,557

(22) Filed: Apr. 5, 2011

(65) Prior Publication Data

US 2011/0239884 A1 Oct. 6, 2011

Related U.S. Application Data

(62) Division of application No. 11/962,692, filed on Dec. 21, 2007.

(30) Foreign Application Priority Data

Dec. 23, 2006 (DE) ..... 10 2006 061 452

(51) Int. Cl.
*B41F 1/34* (2006.01)
*B41F 27/12* (2006.01)

(52) U.S. Cl. ..... 101/485; 101/415.1; 101/477

(58) Field of Classification Search ..... 101/415.1, 101/477, 378, 383, 479, 480, 483, 485
See application file for complete search history.

(56) References Cited

U.S. PATENT DOCUMENTS

| | | | | |
|---|---|---|---|---|
| 2,610,577 | A | 9/1952 | Heintges | |
| 5,074,212 | A * | 12/1991 | Kobler et al. | 101/477 |
| 5,406,888 | A | 4/1995 | Sugiyama et al. | |
| 5,440,985 | A | 8/1995 | Shimmura et al. | |
| 6,216,594 | B1 | 4/2001 | Nakano et al. | |
| 6,644,191 | B2 | 11/2003 | Narui | |
| 6,880,460 | B2 | 4/2005 | Sakamoto | |
| 6,973,876 | B2 | 12/2005 | Nakano et al. | |
| 7,555,983 | B2 | 7/2009 | Iyokawa et al. | |
| 7,690,302 | B2 | 4/2010 | Bernard et al. | |
| 2005/0241517 | A1 | 11/2005 | Trilk et al. | |
| 2005/0263024 | A1 | 12/2005 | Glunz et al. | |

FOREIGN PATENT DOCUMENTS

| | | | |
|---|---|---|---|
| DE | 40 03 445 | C2 | 8/1991 |
| DE | 92 01 293.0 | | 7/1993 |
| DE | 10 2004 022 089 | A1 | 12/2005 |
| DE | 10 2004 052 020 | A1 | 5/2006 |
| DE | 10 2004 052 021 | A1 | 5/2006 |
| EP | 0 441 141 | A2 | 8/1991 |
| EP | 1 391 300 | A1 | 2/2004 |
| GB | 2 413 530 | | 11/2005 |
| WO | WO 2007/140268 | A2 | 12/2007 |

OTHER PUBLICATIONS

European Search Report.
German Search Report w/English translation of Explanations for Section C.

* cited by examiner

*Primary Examiner* — Ren Yan
(74) *Attorney, Agent, or Firm* — Crowell & Moring LLP

(57) ABSTRACT

An apparatus and method for changing printing plates is disclosed. A printing plate cartridge for a printing press has multiple cases for accommodating printing plates to be removed during a printing plate change and for accommodating printing plates to be installed during a printing plate change. The printing plate cartridge is mounted in such a way that it may be moved in a rotationally pivotable fashion and in a linear fashion relative to a printing group of the printing press, such that the printing plate cartridge is able to service multiple printing units of the printing group during a printing plate change.

6 Claims, 5 Drawing Sheets

APPARATUS AND METHOD FOR CHANGING PRINTING PLATES

This application claims the priority of German Patent Document No. 10 2006 061 452.6, filed Dec. 23, 2006, the disclosure of which is expressly incorporated by reference herein.

BACKGROUND AND SUMMARY OF THE INVENTION

The invention relates to an apparatus and method for changing printing plates with a printing plate cartridge for a printing press.

Rotary printing presses have multiple printing groups, with each printing group having several, in particular four, printing units. Each printing group includes a transfer cylinder, a plate cylinder, an inking system, and, optionally, a dampening system. Preferably, printing plates embodied as printing blocks are positioned on the plate cylinders and transfer forms, preferably embodied as rubber offset blankets, are positioned on the transfer cylinders. The form cylinders are also described as plate cylinders and the transfer cylinders as rubber cylinders. If, for example, a change in production must be made to the printing press, among other things, it is necessary to remove an old or used printing plate from a plate cylinder and replace it with a new or unused printing plate. In so doing, the old printing plate that has been replaced is transferred to a printing plate cartridge, with the new printing plate to be installed being held in readiness in the printing plate cartridge.

German Patent Document No. DE 10 2004 022 089 A1 and European Patent Document No. EP 1 391 300 A1 both disclose printing plate cartridges for a printing press having an old case for accommodating printing plates to be removed when changing printing plates and a new case for accommodating printing plates to be installed when changing printing plates. These printing plate cartridges, which are known from the prior art, are mounted on a machine frame of the printing press in a pivotable or rotatable fashion, with each printing plate cartridge serving only one printing unit of a printing group when changing printing plates.

Therefore, according to this prior art, one individual printing plate cartridge must be provided for each printing unit of a printing group. This may lead to problems with the available space in a printing press. Moreover, the printing units have relatively poor accessibility.

Based on this prior art, the object of the present invention is to produce a new type of printing plate cartridge for a printing press.

According to the invention, the printing plate cartridge is mounted in such a way that it may be pivoted in a rotating fashion and moved in a linear fashion, both relative to a printing group of the printing press, such that the printing plate cartridge is able to service multiple printing units of the printing group when changing printing plates.

Using the printing plate cartridge according to the invention, it is possible for multiple printing units of one printing group to be serviced when changing printing plates; thus, when changing printing plates, it is possible to accommodate printing plates that are to be removed from multiple printing units on one side and to hold printing plates in readiness that are to be installed in multiple printing units. This will reduce the space required for the printing plate cartridges. Moreover, the printing units of the printing groups will become lighter as well as more easily accessible.

Preferably, the printing plate cartridge has an outer part that is mounted on a machine frame or a web guide wall and an inner part that is housed inside the outer part, with the outer part and inner part being pivotable together in a rotational fashion relative to the printing group of the printing press and movable in a linear fashion, with the inner part being movable in a linear fashion relative to the outer part, and with the inner part having the cases for accommodating the printing plates.

According to an advantageous embodiment of the invention, the printing plate cartridge has a gripper device for gripping printing plates when changing printing plates, with the gripper device being attached to at least one conveyor chain and being movable along the conveyor chain or each of the conveyor chains, and with the conveyor chain or each of the conveyor chains being guided in a chain guide bar system. The chain guide bar system has first sections, assigned to the outer part, and second sections, assigned to the cases in the inner part, with the first and second sections expanding dependent upon the position of the inner part relative to the outer part in such a way that the gripper device attached to the conveyor chain or each of the conveyor chains may be retracted into the cases of the inner part dependent upon the position of the inner part relative to the outer part.

Preferred embodiments of the invention may be found in the description provided below. One exemplary embodiment of the invention will be described in greater detail with reference to the drawings, without limiting the scope of the invention.

DETAILED DESCRIPTION OF THE DRAWINGS

Figure 1:
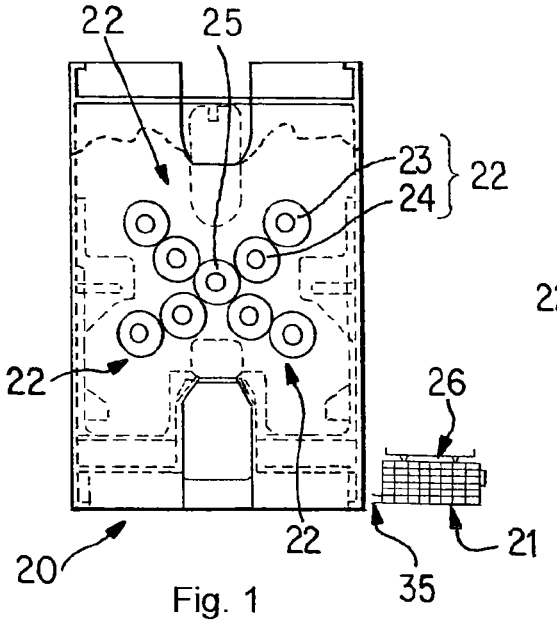
FIG. 1 illustrates a printing group of a rotary printing press along with a printing plate cartridge according to the invention in a first position.

FIGS. 1 to 4 each show a printing group 20 of a rotary printing press along with a printing plate cartridge 21 according to the invention, with the printing plate cartridge 21 being shown in various relative positions to the printing group 20 in FIGS. 1 to 4. In FIGS. 1 to 4, the printing group 20 is embodied as a so-called nine-cylinder satellite printing group, including a total of four printing units 22, each having one plate cylinder 23 and one transfer cylinder 24, with the transfer cylinders 24 of all printing units 22 of a printing group 20 being in a rolling motion on a satellite cylinder 25.

Figure 2:
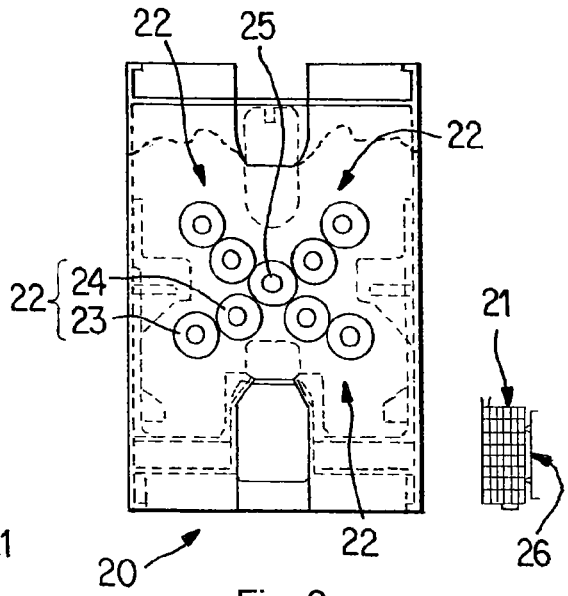
FIG. 2 illustrates the arrangement of FIG. 1 with the printing plate cartridge in a second position.
Figure 3:
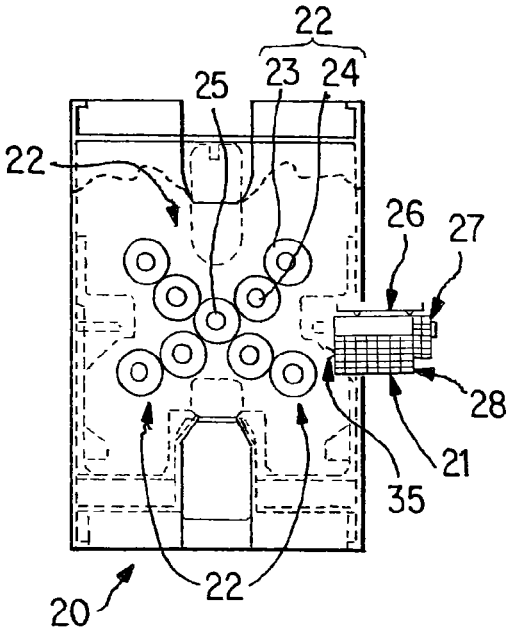
FIG. 3 illustrates the arrangement of FIG. 1 with the printing plate cartridge in a third position.
Figure 4:
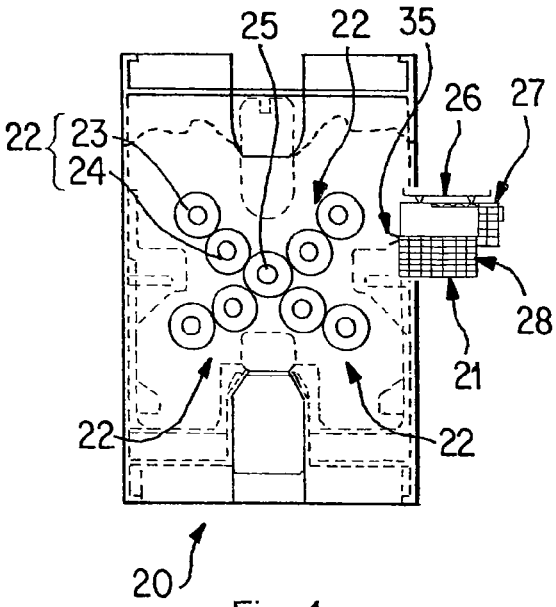
FIG. 4 illustrates the arrangement of FIG. 1 with the printing plate cartridge in a fourth position.

The printing plate cartridge 21 according to the invention is mounted in such a way that it is pivotable in a rotational fashion and movable in a linear fashion, both relative to the printing group 20, such that the printing plate cartridge 21 is able to service multiple printing units 22, namely multiple plate cylinders 23 of multiple printing units 22 when changing printing plates. Thus, FIG. 1 shows the printing plate cartridge 21 in a rest position below the printing unit 22 of the printing group 20; in this rest position, it is possible for service personnel or a printer to climb onto the footboard 26 assigned to the printing plate cartridge 21. In FIG. 2, the printing plate cartridge has been pivoted by 90° relative to the rest position shown in FIG. 1. In the position shown in FIG. 2, a printer is able to remove printing plates from the printing plate cartridge 21 or insert printing plates into the printing plate cartridge 21. FIGS. 3 and 4 each show the printing plate cartridge 21 during a printing plate change, with the printing plate cartridge 21 servicing a plate cylinder 23 of a lower printing unit 22 in FIG. 3 and a plate cylinder 23 of an upper printing unit 22 of the printing group 20 in FIG. 4. The printing plate cartridge 21 is therefore pivotable and movable in a linear fashion relative to the printing group 20.

The printing plate cartridge 21 according to the invention has an outer part 27 mounted on a machine frame or a web guide wall as well as an inner part 28 positioned inside the outer part 27. The outer part 27 as well as the inner part 28 may be pivoted in a rotational fashion and moved in a linear fashion, both relative to the printing group 20.

The inner part 28 may be moved in a linear fashion relative to the outer part 27, which may be seen in particular from a comparison of FIGS. 3 and 4. According to FIGS. 3 and 4, the inner part 28 may be moved out of the outer part 27 in the vertical direction and inserted into it. The inner part 28 of the printing plate cartridge 21 may therefore be moved up and away from the outer part 27 of the printing plate cartridge 21.

The inner part 28 of the printing plate cartridge 21 has multiple cases 29 for accommodating printing plates. In the exemplary embodiment shown, the inner part 28 has a number of five cases located one above the other and six cases located one next to the other, respectively, for accommodating one printing plate each. Therefore, the inner part 28 of the printing plate cartridge 21 has a total of thirty cases 29 for accommodating one printing plate each.

In order to perform the printing plate change on a plate cylinder 23 of a printing unit 22 of the printing group 20, the printing plate cartridge 21, including an outer part 27 and an inner part 28, is positioned relative to the plate cylinder 23 and the inner part 28 is displaced relative to the outer part 27 in such a way that, for removal as well as for installation, the correct cases 29 of the inner part 28 of the printing plate cartridge 21 are aligned with the plate cylinder for performing the printing plate change. In so doing, the position of the inner part 28 of the printing plate cartridge 21 relative to the outer part 27 of the printing plate cartridge 21 determines the cases 29 of the inner part 28 that may be used in changing printing plates.

Figure 10:
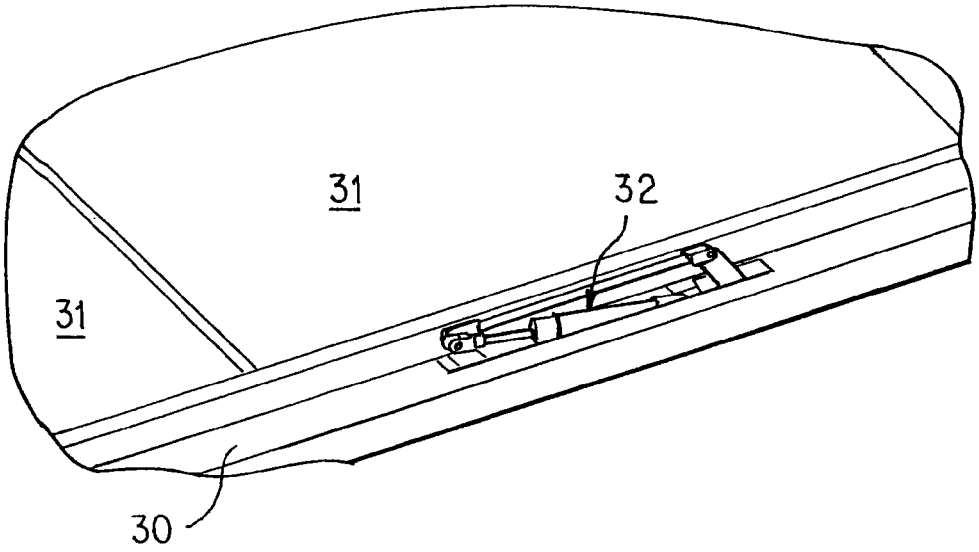
FIG. 10 is a detail of the printing plate cartridge according to the invention.
Figure 11:
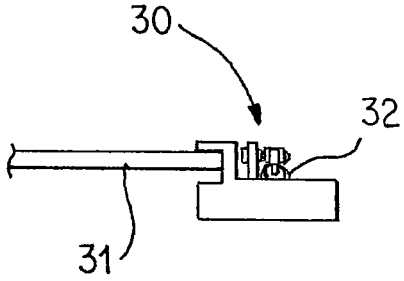
FIG. 11 illustrates the detail of FIG. 10 in a different view.

In order to grip and subsequently handle the printing plates while performing a printing plate change, the printing plate cartridge 21 according to the invention includes a gripper device 30. FIGS. 10 and 11 show the gripper device 30 along with a printing plate 31. The gripper device 30 may be activated by way of a cylinder 32 in order to grasp printing plates, either with the aid of a clasping mechanism or a clamping mechanism in the gripper device 30.

Figure 5:
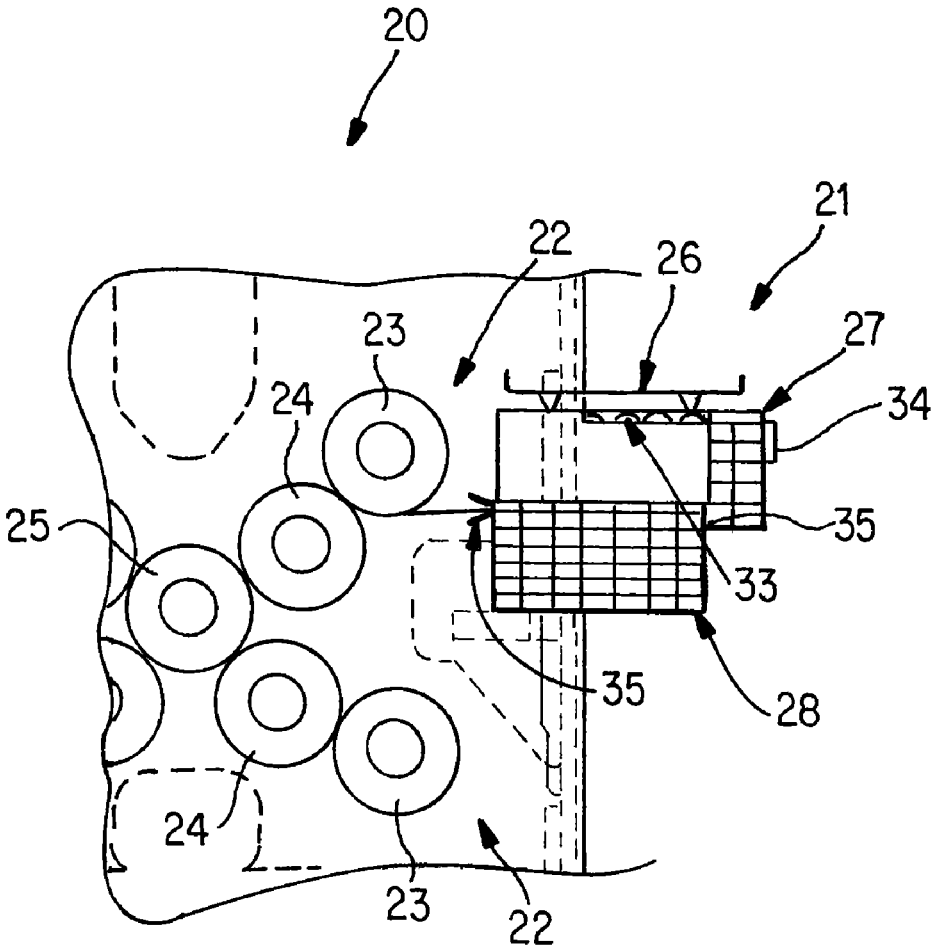
FIG. 5 is an enlarged detail of FIG. 4.
Figure 6:
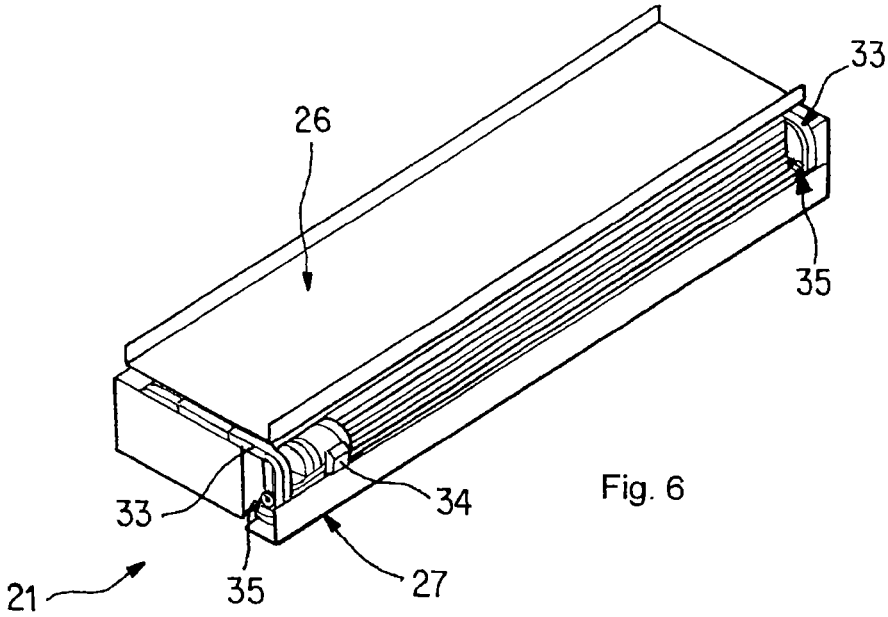
FIG. 6 illustrates a printing plate cartridge according to the invention.
Figure 7:
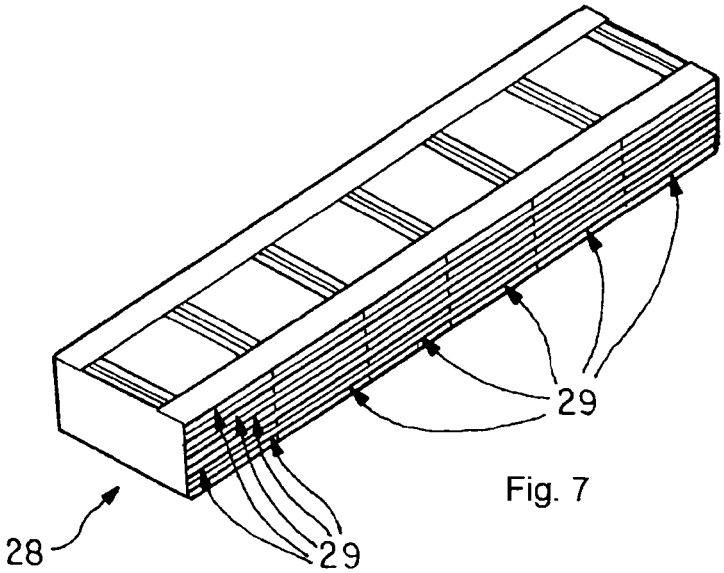
FIG. 7 is a detail of the printing plate cartridge according to the invention.
Figure 8:
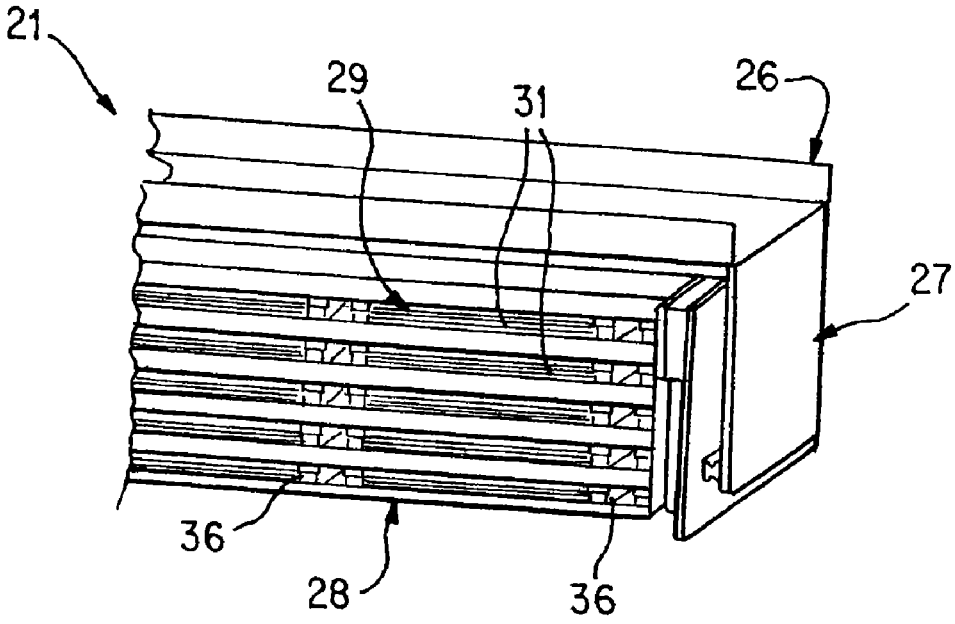
FIG. 8 shows a section of the printing plate cartridge according to the invention.
Figure 9:
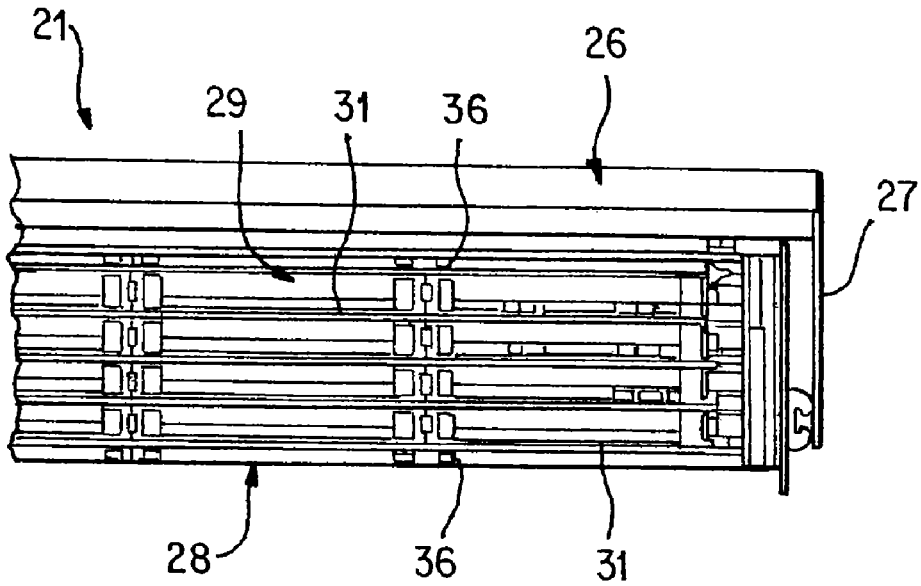
FIG. 9 shows the section of FIG. 8 in a different view.

The gripper device 30 is attached to a conveyor chain on each side, which is not shown, and may be moved via the conveyor chains, with the conveyor chains being guided in a chain guide bar system 33 (see in particular FIGS. 5 and 6). In principle, the chain guide bar system 33 is divided into different sections, namely first sections that are assigned to the outer part 27 of the printing plate cartridge 21 and the second sections that are assigned to the cases 29 of the inner part 28. Depending on the position of the inner part 28 relative to the outer part 27 of the printing plate cartridge 21, the first sections and second sections of the chain guide bar system 33 may expand.

Therefore, the position of the inner part 28 of the printing plate cartridge 21 relative to the outer part 27 of the printing plate cartridge 21 determines which of the second sections of the chain guide bar system 33 assigned to the cases 29 of the inner part 28 will expand the first sections of the chain guide bar system 33 assigned to the outer part 27 of the printing plate cartridge 21. This ultimately establishes into which of the cases 29 of the inner part 28 of the printing plate cartridge 21 the conveyor chains and thus the gripper device 30 attached to the conveyor chains may be inserted.

In order to drive the conveyor chains, a drive 34 is provided, which provides drive to the conveyor chains by way of drive wheels in order to move the gripper device 30.

According to FIG. 6, first sections of the chain guide bar system 33 assigned to the outer part 27 extend on both sides of the printing plate cartridge 21. The gripper device 30 extends over the same width of the printing plate cartridge 21 such that it may be retracted simultaneously into six cases 29 of the inner part 28 that are arranged one next to the other. Therefore, it is possible for six printing plates 31 to be removed at the same time from cases 29 of the printing plate cartridge 21 and supplied to a plate cylinder 23 for installation thereon and for a corresponding number of printing plates to be inserted into the cases 29 of the printing plate cartridge 21 after being removed.

As can be best seen from FIG. 5, a funnel 35 is assigned to the outer part 27 of the printing plate cartridge 21. Dependent upon the position of the inner part 28 relative to the outer part 27 of the printing plate cartridge 21, the funnel 35 cooperates with different cases 29 of the inner part 28. Especially in the removal of printing plates from a plate cylinder 23, the funnel 35 facilitates the insertion of removed printing plates into the cases 29 of the inner part 28 of the printing plate cartridge 21.

Separating bridges 36 are integrated into the cases 29 of the inner part 28 of the printing plate cartridge 21 that may be engaged against or disengaged by the printing plates 31 accommodated in the cases 29. When engaged against the printing plates 31, the separating bridges 36 define the position of the printing plates within the cases 29 of the inner part 28 of the printing plate cartridge 21.

LIST OF REFERENCE CHARACTERS

20 Printing group
21 Printing plate cartridge
22 Printing unit
23 Plate cylinder
24 Transfer cylinder
25 Satellite cylinder
26 Footboard
27 Outer part
28 Inner part
29 Case
30 Gripper device
31 Printing plate
32 Cylinder
33 Chain guide bar system
34 Drive
35 Funnel
36 Separating bridge The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A method for changing a printing plate in a printing press, comprising the steps of:

providing a printing plate cartridge for the printing press having (1) multiple cases for accommodating printing plates to be removed during a printing plate change and for accommodating printing plates to be installed during a printing plate change, the printing plate cartridge being mounted in such a way that it is rotationally pivotable and linearly movable relative to a printing group of the printing press, such that multiple printing units of the printing group are serviceable by the printing plate cartridge during a printing plate change, and (2) a gripper device for gripping printing plates during the printing plate change, the gripper device being attached to a conveyor chain and movable by way of the conveyor chain, the conveyor chain being guided in a chain guide bar system, the chain guide bar system having first sections assigned to an outer part of the printing plate cartridge and second sections assigned to the cases of an inner part of the printing plate cartridge, with the first and second sections expanding dependent upon a position of the inner part relative to the outer part in such a way that the gripper device is insertable into the cases of the inner part dependent upon the position of the inner part relative to the outer part;

changing a first of the printing plates on a first plate cylinder of a first printing unit of a printing group by the printing plate cartridge, wherein the printing group is housed in a frame;

moving the printing plate cartridge on the frame to a position adjacent to a second plate cylinder of a second printing unit of the printing group; and changing a second of the printing plates on the second plate cylinder of the second printing unit of the printing group by the printing plate cartridge.

2. The method according to claim 1, wherein the step of moving the printing plate cartridge on the frame includes the step of linearly moving the printing plate cartridge on the frame.

3. The method according to claim 1, further comprising the step of rotating the printing plate cartridge on the frame.

4. The method according to claim 1, further comprising the step of moving the printing plate cartridge on the frame to a position adjacent to the first plate cylinder of the first printing unit of the printing group.

5. The method according to claim 4, wherein the step of moving the printing plate cartridge on the frame to the position adjacent to the first plate cylinder of the first printing unit of the printing group includes the step of linearly moving the printing plate cartridge on the frame.

6. The method according to claim 1, wherein the outer part is mounted on the frame and the inner part is linearly moveable relative to the outer part, and wherein the step of changing the first of the printing plates on the first plate cylinder and the step of changing the second of the printing plates on the second plate cylinder include linearly moving the inner part relative to the outer part such that a respective printing plate case of the multiple cases is aligned with the first and second plate cylinders, respectively.

* * * * *